United States Patent [19]

Rösler et al.

[11] 3,957,311

[45] May 18, 1976

[54] SCRAPER CHAIN CONVEYOR WITH VENTILATION PARTS

[75] Inventors: Wulff Rösler, Altlunen; Christoph Rassmann, Lunen, both of Germany

[73] Assignee: Gewerkschaft Eisenhutte Westfalia, Westphalia, Germany

[22] Filed: Apr. 30, 1975

[21] Appl. No.: 572,967

[30] Foreign Application Priority Data

June 7, 1974 Germany ..... 2427555

[52] U.S. Cl. ..... 299/43; 198/168; 198/204; 299/12

[51] Int. Cl.[2] ..... E21C 35/20

[58] Field of Search ..... 299/32, 34, 43–46; 198/168, 171, 189, 204

[56] References Cited

UNITED STATES PATENTS 3,700,284 10/1972 Agnew ..... 299/46

FOREIGN PATENTS OR APPLICATIONS 2,061,387 6/1972 Germany ..... 198/204

*Primary Examiner*—Ernest R. Purser
*Attorney, Agent, or Firm*—Charles E. Pfund

[57] ABSTRACT

A conventional form of scraper-chain conveyor with a series of channel sections each having a floor disposed between sigma-shaped side walls has upstanding spill plates, C-shaped covers and hollow spacer bars attached to the goaf side of each channel section. These components define upper and lower guide channels for a drive chain circulated along the goaf side of the conveyor which is connected through a sword plate to a machine guided for movement along the conveyor. To prevent gases from building up beneath the conveyor vents are provided in the goaf side wall of the channel sections and these vents communicate with the external V-shaped grooves in the side walls.

Vents are also provided in the spill plates to establish communication between the V-shaped grooves and the upper chain guide channel. The covers are then spaced apart to form apertures allowing any gas which reaches the upper channel to pass to the surroundings. To prevent fine material from blocking the gas vents, guard plates are provided on the spacer bars in the upper channel which form barriers which surround and shield the vents while permitting gas to pass into the upper channel.

15 Claims, 3 Drawing Figures

SCRAPER CHAIN CONVEYOR WITH VENTILATION PARTS

BACKGROUND TO THE INVENTION

The present invention relates to a scraper-chain conveyor for use in underground mining operations and particularly in coal mines.

It is known to construct a scraper-chain conveyor from a series of channel sections each having side walls adjoined by a floor and to provide hoods or covers and the like on the goaf side of these channel sections. In this manner chain guide channels can be defined at the goaf side for receiving a chain used to propel a mining or loading machine along the conveyor. Usually such a machine would employ a sword plate extending beneath the conveyor and connected to the chain.

When such conveyors are employed in connection with the mining of bituminous minerals it is possible that the normal ventillation system is not effective in preventing the accumulation of firedamp, i.e. methane gas, trapped beneath the conveyor with the consequential risk of fire or explosion.

A general object of the invention is to provide a modified form of conveyor which will be effective in precluding this building up of gas beneath the conveyor. A further object of the invention is to provide means whereby blockage of the passageways provided for the escape of the gas can be prevented or inhibited.

BRIEF SUMMARY OF THE INVENTION

According to the invention there is provided a scraper-chain conveyor for use in mineral mining, said conveyor comprising a series of channel sections arranged end-to-end, each channel section being composed of side walls interconnected by a floor, shaped covers and spacer bars attached to one common side of the channel sections to define thereat upper and lower guide channels which serve to receive a drive chain for a machine guided for movement along the conveyor, vents in said one common side of the channel sections for permitting any accumulated gas to pass from the region from beneath the floors of the channel sections to the upper chain guide channel for subsequent escape therefrom and guard plates for shielding the vents whereby to inhibit the vents from becoming blocked by the ingress of material while permitting the passage of the gas to said upper guide channel.

The guard plates are preferably attached to the spacer bars. Preferably Generally-upstanding side plates are also attached to the one common side of the channel sections and are located between said one common side and the covers and spacer bars. Further vents can then be provided in these side plates to permit the gas to pass from the first-mentioned vents to the upper channel. The guard plates can serve to shield and protect both the first-mentioned and further vents from contamination by the ingress of dirt or coal dust for example. Normally the side walls of the channel sections would be of sigma-shape in cross-section with external V-shaped grooves with which the first mentioned vents communicate. The further vents then permit communication between the V-shaped grooves and the upper channel. To permit the gas to pass from the upper channel to the surroundings and hence to be removed by the normal ventilation system successive covers can be spaced apart to leave narrow slits therebetween.

In a preferred form each guard plate has a main portion spaced from the adjacent side plate to permit gas emerging from the associated further vent or vents to pass between this main portion and this side plate to enter the upper guide channel and end portions which extend inwardly towards the adjacent side plate.

The guard plates can be fabricated from narrow gauge metal strip or plate and to protect these components from damage by the chain it is desirable to provide wear-resistant blocks which are, for example, secured to the side plates between the guard plate.

The spacer bars with their associated guard plates can conveniently form a replaceable unit. For example, each bar can have upper and lower parallel plates with end portions bent inwardly together and joined together by welding and cross bars disposed between said plates. The associated guard plate can then be affixed to the upper plate of the bar, the guard plate having a main portion spaced from an inner face of the bar adjacent the channel sections and end portions which converge towards this inner face with the ends of the guard plate being aligned with the inner face.

The prior securing of the guard plates to the spacer bars is advantageous in assuring that when assembled the guard plates will become positioned correctly in relation to the vents.

The invention will be understood more readily and various other features of the invention may become more apparent from consideration of the following description.

BRIEF DESCRIPTION OF DRAWINGS

An embodiment of the invention will now be described, by way of example only, with reference to the accompanying drawing, wherein.

DESCRIPTION OF PREFERRED EMBODIMENT

Figure 1:
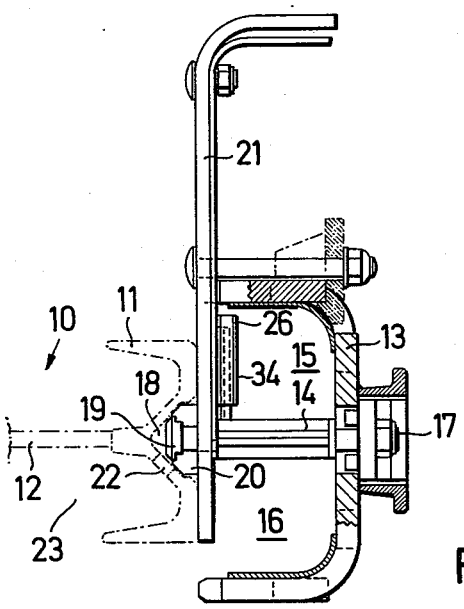
FIG. 1 is a schematic cross-section through part of a scraper-chain conveyor made in accordance with the invention.
Figure 2:
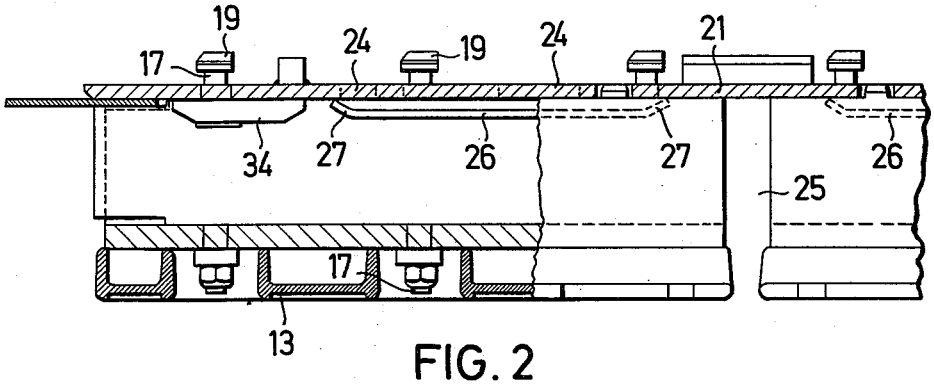
FIG. 2 is a plan view, partly in section, of part of the scraper-chain conveyor.

In known manner, the scraper-chain conveyor made in accordance with the invention is composed of a series of channel sections arranged end-to-end along which a scraper-chain assembly is moved to transfer material. Each of these channel sections is itself constructed from two generally sigma-shaped side walls interconnected by a conveyor floor. Since these features are well known per se they have not been fully illustrated in the drawing. Referring initially to FIG. 1, a lateral portion of a channel section of the conveyor, generally denoted 10, is shown in chain-dotted lines wherein the floor is denoted 12 and the goaf-side side wall is denoted 11. The following description is concerned with attachments provided on the side wall 11 of this single channel section but it is to be understood that such attachments would normally be employed on most, if not all, of the channel sections. Thus, two substantially C or U-shaped covers 13 are attached to the goaf side wall 11 of each channel section with the aid of two hollow spacer bars 14. More particularly each cover 13 forms a constructional unit with an associated spacer bar 14 and two of these units are affixed to the wall 11 of each channel section with the aid of nut and bolt assemblies 17. The bolts of these assemblies extend through the spacer bars 14 with the nuts locating in recesses formed at the external side of the cover 13 (FIG. 2). The heads 19 of the bolts 17 engage on individual holding pieces 20 welded into the conventional V-shaped recess 18 at the outside of the associated channel section side wall 11. The units 13, 14 are spaced apart longitudinally of the side walls 11 to leave slit-like apertures 25 (FIG. 2) between adjacent units. Upstanding side or spill plates 21 extend upwardly from the side walls 11 of the channel sections and lie alongside the external faces thereof. The upper ends of the plates 21 are bent over as shown in FIG. 1. These assemblies 17 also serve to secure the plates 21 in position. The plates 21 can support a variety of accessories or attachments as depicted in FIG. 1.

As shown in FIG. 1, the units 13, 14 affixed to the side wall 11 of each conveyor channel section define upper and lower chain-guide channels 15,16 respectively. In known manner, a mineral winning machine (not shown) such as a plough can be moved back and forth along the conveyor to win mineral. To effect the movement of this machine a sword plate known per se (not shown) is attached to the machine and extends beneath the conveyor. This sword plate is drivably secured to an endless drive chain (not shown) having an upper run located in the channel 15 and a lower run located in the channel 16. This chain is circulated in moves within these channels 15, 16 to drive the machine along the conveyor.

To permit the escape of gases, espcially firedamp, which might tend to accumulate beneath the floors 12 of the channel sections of the conveyor, i.e. in the region denoted 23 in Figure, in certain mine workings the channel section side walls 11 have vents 22 therein located as shown in FIG. 1 to connect the region 23 directly to the external V-shaped recesses 18 of the side walls 11. The plates 21 are similarly provided with vents 24 which establish communication between the channels 16 and the recesses 18. The gas can thus pass from the region 23 through the vents 22 to the recesses 18 and thence through the vents 24 to the channels 15 to emerge to the surroundings via the apertures 25 between adjacent vents 13, 14.

In order to prevent fine material which enters the channel 15 from passing from the channels 15 back into the vents 24 or 22 and causing blockages therein, guard plates 26 are provided.

As shown in FIG. 2, these guard plates 26 are spaced laterally from the vents 24 in the plates 21 so that the gas can pass upwardly through the spaces between the plates 21, 36 after emerging through the vents 24. The end portions 27 of each plate 26 are however bent inwardly to contact the associated plate 21 and provide barriers to prevent the ingress of fine material into the space between the plates 21, 26.

To prevent the guard plates 26 from becoming damaged by the chain running in the channel 15 wear-resistant blocks 34 are affixed to the plates 21 between the guard plates 26.

Figure 3:
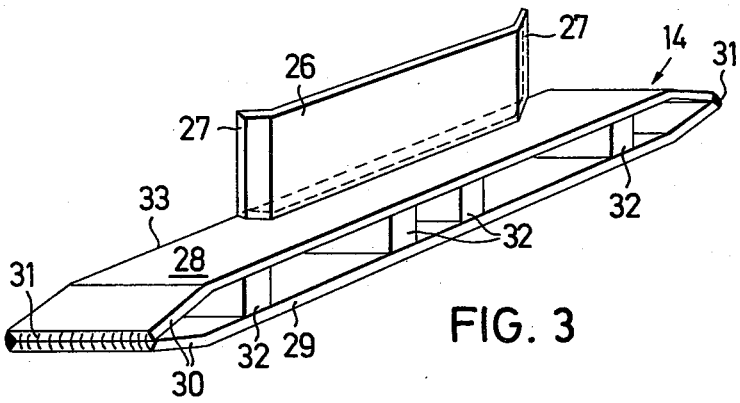
FIG. 3 is a perspective view of a component of the conveyor.

As shown in FIG. 3, each spacer bar 14 is of composite form and has one of the guard plates 26 secured to its upper face, for example, by welding. The spacer bar 14 itself is constructed from two parallel plates 28,29 having inwardly-bent end portions 30 which converge and meet at welded junctures 31 defining the ends of the bar 14. Cross bars 32 are welded between the plates 28, 29 to reinforce the structure and define the openings for receiving the bolts of the assemblies 17. The bent end portions 27 of the associated plate 26 are aligned with the inner face 33 of the bar 14.

We claim:

1. A scraper-chain conveyor for use in mineral mining, said conveyor comprising a series of channel sections arranged end-to-end, each channel section being composed of side walls interconnected by a floor, shaped covers and spacer bars attached to one common side of the channel sections to define thereat upper and lower guide channels which serve to receive a drive chain for a machine guided for movement along the conveyor, vents in said one common side of the channel sections for permitting any accumulated gas to pass from the region from beneath the floors of the channel sections to the upper chain guide channel for subsequent escape therefrom and guard plates for shielding the vents whereby to inhibit the vents from becoming blocked by the ingress of material while permitting the passage of the gas to said upper guide channel.

2. A conveyor according to claim 1, wherein generally upstanding side plates are also attached to the one common side of the channel sections and are located between said one common side and the covers and spacer bars and wherein further vents are provided in said side plates which permit the passage of the gas from the vents in said one common side to the upper chain guide channel, the guard plates serving to also shield these further vents.

3. A conveyor according to claim 1, wherein the guard plates are secured to the spacer bars.

4. A conveyor according to claim 1, wherein the side walls of each channel section are generally sigma-shaped in cross-section wit external V-shaped recesses, the vents permitting communication between said region and the V-shaped recesses.

5. A conveyor according to claim 2, wherein the side walls of each channel section are generally sigma-shaped in cross-section with external V-shaped recesses, the vents permitting communication between said region and the V-shaped recesses, and wherein the further vents in the side plates permit communication between the V-shaped recesses and the upper guide channels.

6. A conveyor according to claim 1, wherein the adjacent covers are spaced apart to allow any gas in the upper guide channel to pass to the surroundings.

7. A conveyor according to claim 2, wherein each guard plate has a main portion spaced from the adjacent side plate to permit gas emerging from the associated further vent or vents to pass between this main portion and this side plate to enter the upper guide channel and end portions which extend inwardly towards the adjacent side plate.

8. A conveyor according to claim 1, wherein wear resistant blocks are provided in the upper guide channel to protect the guard plates.

9. A conveyor according to claim 2, wherein wear resistant blocks are secured to the side plates between the guard plates to protect the guard plates.

10. A conveyor according to claim 1, wherein the spacer bars are hollow and the covers and spacer bars are affixed to the channel sections with the aid of nut-and-bolt assemblies having bolts which extend through the spacer bars.

11. A conveyor according to claim 10, wherein the side walls of each channel section are generally sigma-shaped in cross-section with external V-shaped grooves and the heads of the bolts of the nut-and-bolt assemblies engage on individual holding pieces welded into the V-shaped grooves at said one common side of the channel sections.

12. A conveyor according to claim 1, wherein the spacer bars are of composite construction each having upper and lower parallel plates with end portions bent inwardly together and joined together by welding and cross bars disposed between said plates.

13. A conveyor according to claim 12, wherein each spacer bar has one of guard plates affixed to its upper plate, each plate having a main portion spaced from an inner face of the bar adjacent the channel sections and end portions which converge towards this inner face with the ends of the guard plate being aligned with the inner face.

14. A conveyor according to claim 1, wherein each channel section has two covers and two spacer bars attached thereto.

15. A conveyor according to claim 14, wherein each spacer bar carries one of the guard plates.

* * * * *